US008628340B2

(12) United States Patent
Chiu et al.

(10) Patent No.: US 8,628,340 B2
(45) Date of Patent: Jan. 14, 2014

(54) CONNECTOR MOUNTED VERTICALLY THROUGH A HOLE IN A PRINTED CIRCUIT BOARD

(75) Inventors: Chin-Yu Chiu, New Taipei (TW); Cheng-Chih Hsu, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 15 days.

(21) Appl. No.: 13/435,159

(22) Filed: Mar. 30, 2012

(65) Prior Publication Data

US 2012/0270422 A1 Oct. 25, 2012

(30) Foreign Application Priority Data

Apr. 20, 2011 (TW) ..... 100206974 A

(51) Int. Cl.
*H01R 12/00* (2006.01)

(52) U.S. Cl.
USPC ..... 439/83

(58) Field of Classification Search
USPC ..... 439/83, 247–248, 374, 284
See application file for complete search history.

(56) References Cited

U.S. PATENT DOCUMENTS

| | | | | |
|---|---|---|---|---|
| 6,074,230 | A * | 6/2000 | Comerci et al. | 439/284 |
| 6,146,184 | A * | 11/2000 | Wilson et al. | 439/374 |
| 6,579,111 | B2 * | 6/2003 | Fukamachi | 439/247 |
| 6,773,286 | B1 * | 8/2004 | Wu | 439/247 |
| 8,360,796 | B2 * | 1/2013 | Daubigney | 439/345 |
| 2008/0182457 | A1 * | 7/2008 | Wu | 439/626 |

* cited by examiner

*Primary Examiner* — Chandrika Prasad
(74) *Attorney, Agent, or Firm* — Li & Cai Intellectual Property (USA) Office

(57) ABSTRACT

A vertical connector including an insulating body, a conductive casing and a terminal set. The insulating body has a plurality of spaced formed terminal grooves thereon. The conductive casing is assembled with the insulating body and has an insertion opening. The terminal set has a plurality of terminals disposed on the terminal grooves. Each terminal has a fixing segment assembled on the bottom surface of the insulating body, an extending segment formed by bending the free end of the fixing segment toward the insertion opening and a connecting segment formed by extending from the free end of the extending segment.

20 Claims, 8 Drawing Sheets

CONNECTOR MOUNTED VERTICALLY THROUGH A HOLE IN A PRINTED CIRCUIT BOARD

CROSS-REFERENCE TO RELATED APPLICATION

This application claims the priority benefit of Taiwan application serial no. 100206974, filed on Apr. 20, 2011. The entirety of the above-mentioned patent application is hereby incorporated by reference herein and made a part of this specification.

BACKGROUND OF THE INVENTION

1. Field of the Invention

The present invention relates to a connector and an assembly having the same. In particular, the present invention relates to a vertical connector and an assembly having the same.

2. Description of Related Art

With the development of wireless communication and electronic application, it is necessary to transfer a lot of data from one device to another. Electrical connectors are assembled on a printed circuit board and widely used for transferring data. The quality of the electrical connectors is focused to improve the reliability of product and the size of the electrical connectors is shrunk to meet the requirement of small-size and portable products.

In terms of electrical connector, vertical connectors, which stand vertically on the printed circuit boards (PCB), are a form of connector commonly found in the market. The traditional vertical connector includes an insulating base and a plurality of conductive pins fixed on the insulating base. The welding portion of each conductive pin is exposed form the insulating base and located at the bottom of the insulating base. When the vertical connector is fixedly mounted on PCB, the vertical connector is totally protruded on the PCB so that the total length of the connector assembly (i.e., the combination of the connector and the PCB) is the sum of the height of the vertical connector and the thickness of the PCB. Thus, it is need to design enough space in the electrical product to accommodate the connector assembly. In other words, the size of the electrical product is limited to accommodate the connector assembly and cannot be easily reduced. Furthermore, the arrangement of another device or chip on PCB may be adjusted to mount the vertical connector, or another PCB of larger size is used to carry all of the devices, chips and connectors. In other words, the traditional vertical connector do not meet the requirement of small-size and portable products.

SUMMARY OF THE INVENTION

One object of the instant disclosure is providing a vertical connector. The vertical connector can penetrate through the carrying board; therefore, the protruding height of the vertical connector from the carrying board is smaller than that of traditional vertical connector.

The instant disclosure provides a vertical connector including an insulating body, a conductive casing and a terminal set. The insulating body has a plurality of spaced formed terminal grooves thereon. The conductive casing is assembled with the insulating body and has an insertion opening. The terminal set has a plurality of terminals disposed on the terminal grooves. Each terminal has a fixing segment assembled on the bottom surface of the insulating body, an extending segment formed by bending the free end of the fixing segment toward the insertion opening and a connecting segment formed by extending from the free end of the extending segment.

The instant disclosure provides an assembly of a vertical connector including a vertical connector and a printed circuit board (PCB) for carrying the vertical connector. The vertical connector includes an insulating body, a conductive casing and a terminal set. The insulating body has a plurality of spaced formed terminal grooves thereon. The conductive casing is assembled with the insulating body and has an insertion opening. The terminal set has a plurality of terminals disposed on the terminal grooves. Each terminal has a fixing segment assembled on the bottom surface of the insulating body, an extending segment formed by bending the free end of the fixing segment toward the insertion opening and a connecting segment formed by extending from the free end of the extending segment. The PCB having a through hole corresponding to the vertical connector. The vertical connector penetrates through the through hole and the connecting segment of the terminal is fixed with the PCB.

Because that the position of the connecting segment of the terminal extends to the side of the vertical connector, the vertical connector can penetrate through the PCB to fix and contact the connecting segment onto the PCB. As a result, the protruding height of the vertical connector on the PCB is reduced and the size of the electrical products can be shrunk.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

The present invention provides a vertical connector (i.e., pass-through electrical connector) and the combination thereof. By penetrating the vertical connector through the printed circuit board, the height of the vertical connector on the printed circuit board may be reduced and the size of the electronic device having the vertical connector is further shrunk.

Figure 1:
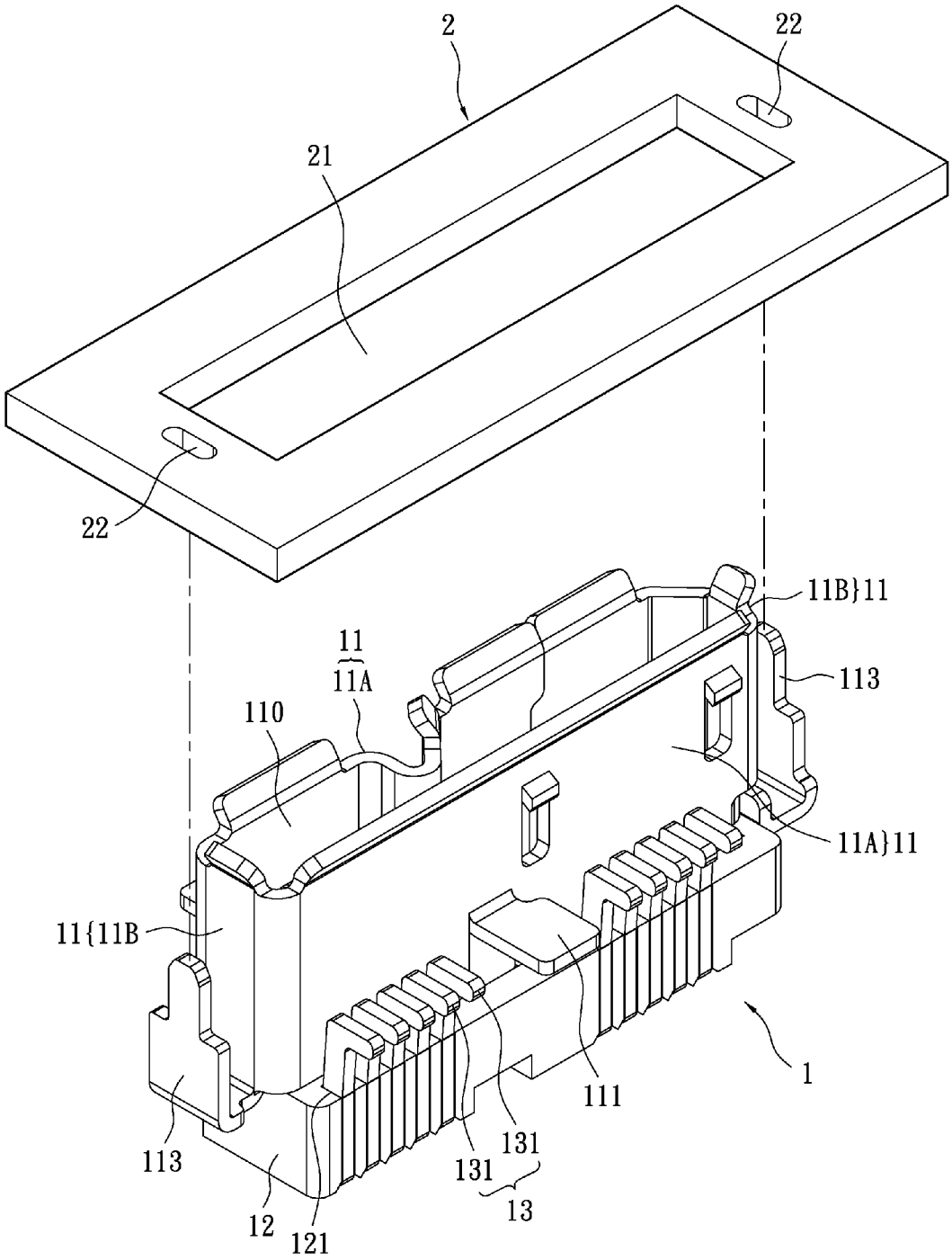
FIG. 1 shows an exploded view of the first embodiment of the vertical connector of the instant disclosure.
Figure 1A:
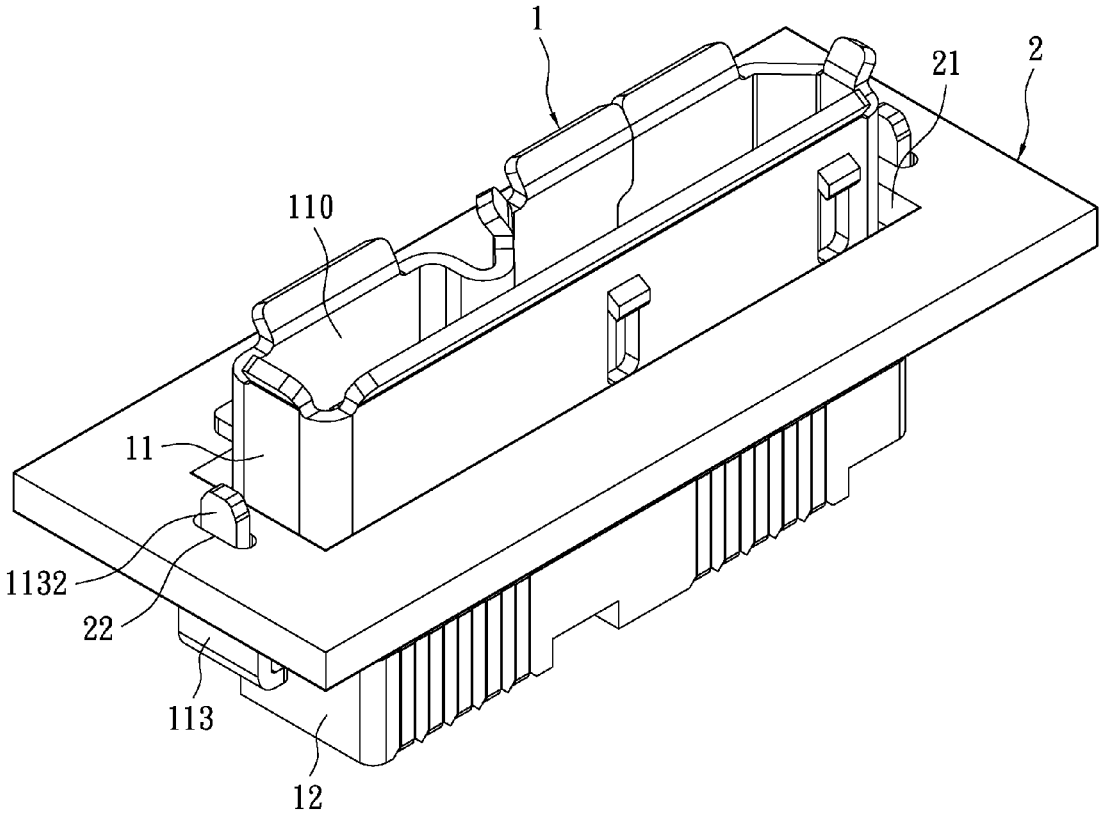
FIG. 1A shows a perspective view of the first embodiment of the vertical connector of the instant disclosure.

Please refer to FIGS. 1 and 1A; the vertical connector 1 is shown and is provided for being inserted by a corresponding electrical connector, for example, the vertical connector 1 is a USB female slot in which a USB male connector (not shown) is capable to insert. The vertical connector 1 at least includes a conductive casing 11, an insulating body 12 and a terminal set 13. The insulating body 12 is provided for a main carrier for assembling the conductive casing 11 and the terminal set 13 thereon. In structural detail, the insulating body 12 has a plurality of terminal grooves 121 spaced form each other thereon, and the terminals 131 of the terminal set 13 are respectively fixedly assembled in the terminal grooves 12. The conductive casing 11 is assembled onto the insulating body 12, for example the metallic casing 11 is secured to the insulating body 12 so as to cover the insulating body 12. The conductive casing 11 is constructed as an insertion slot having an insertion opening 110 so that the USB male connector inserts into the slot of the conductive casing 11 through the insertion opening 110 to contact the terminal set 13 and the USB female slot and the USB male connector are electrically connected to each other.

Figure 3:
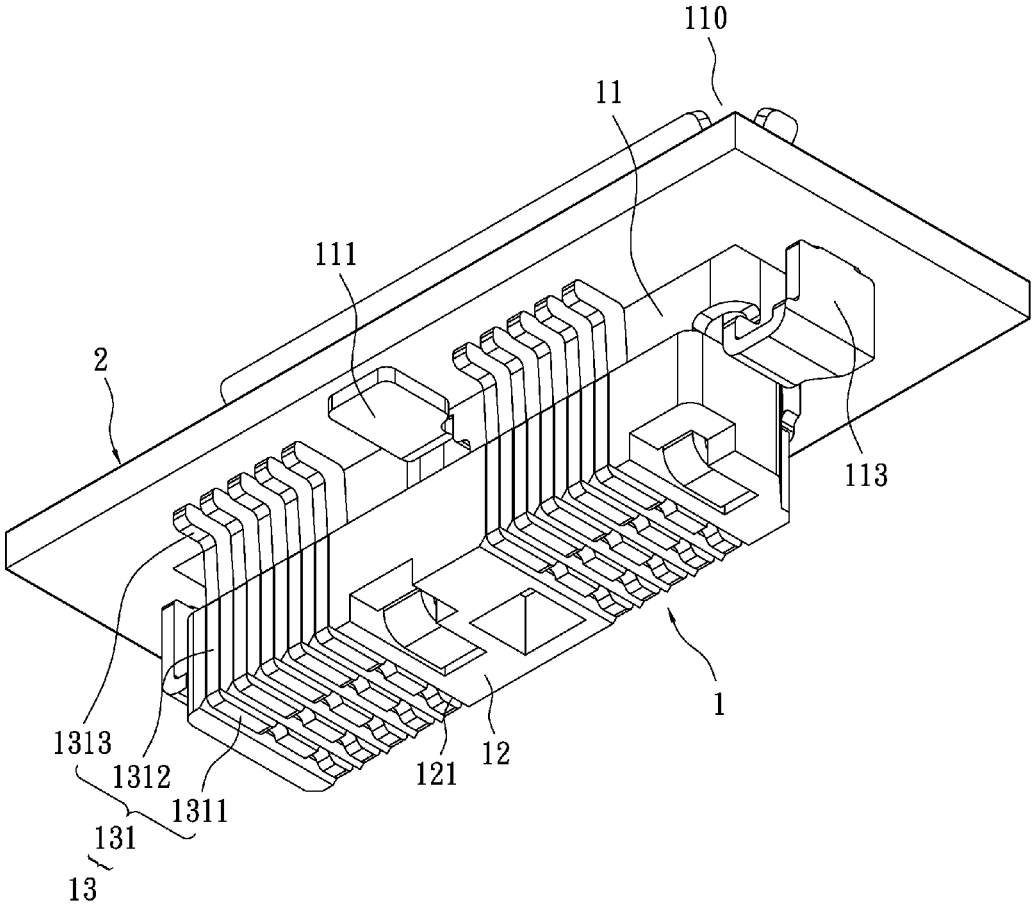
FIG. 3 shows a bottom view of the first embodiment of the vertical connector of the instant disclosure.

Please refer to FIG. 3; each terminal 131 has a fixing segment 1311 assembled on the bottom surface of the insulating body 12, an extending segment 1312 formed by bending the free end of the fixing segment 1311 toward the insertion opening 110 and a connecting segment 1313 formed by extending from the free end of the extending segment 1312. In other words, the terminal 131 is a metal piece having multi bending portions and extends from the bottom of the vertical connector 1 to the side of the vertical connector 1 so that when the vertical connector 1 is assembled to the printed circuit board (PCB) 2, the connection position is located at the side of the vertical connector 1 due to the position of the connecting segment 1313. In other words, the bottom of the vertical connector 1 and the insertion opening 110 is located at two sides of PCB 2 so that the height or length of the vertical connector 1 protruding from PCB 2 can be reduced.

Figure 2:
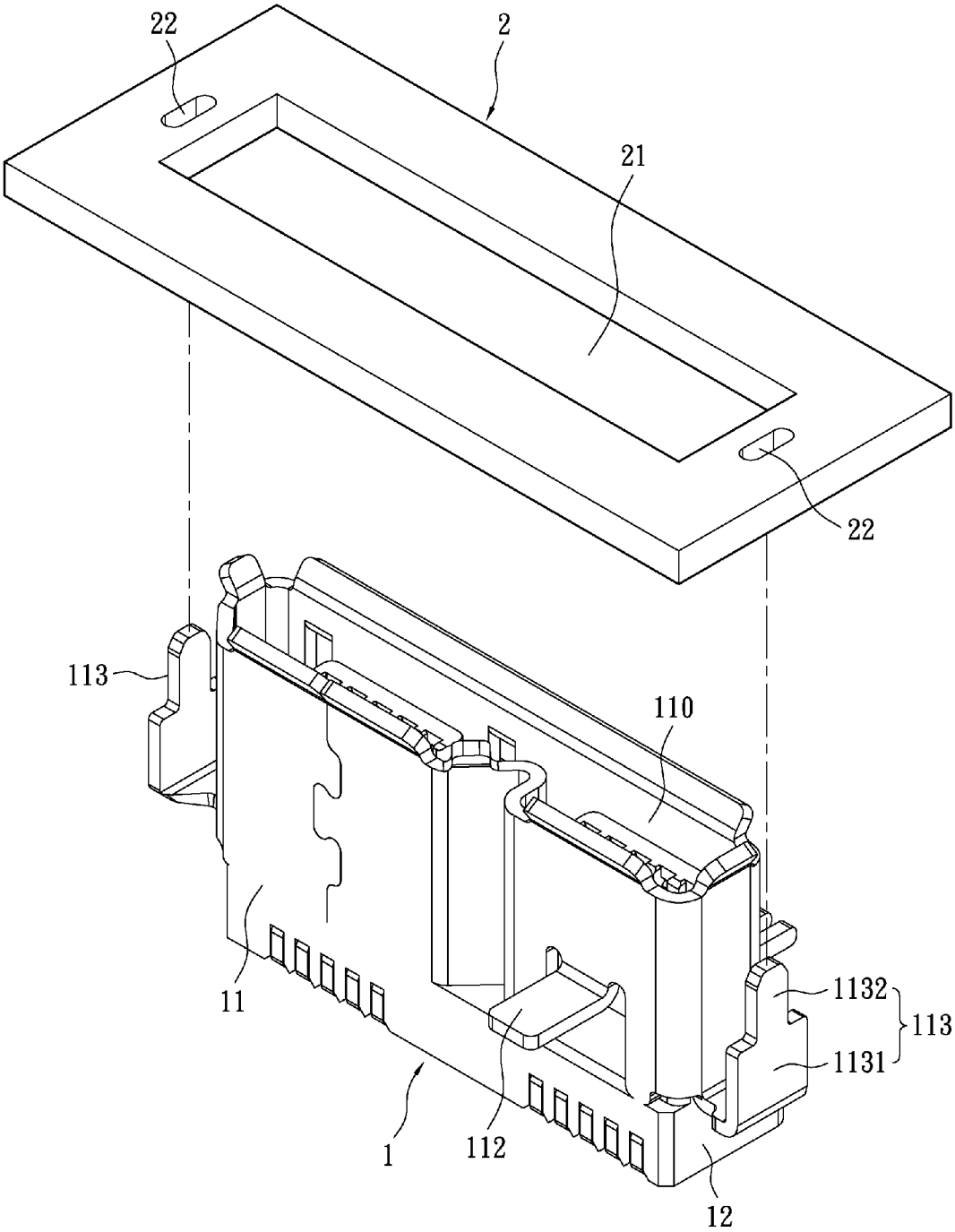
FIG. 2 shows another exploded view of the first embodiment of the vertical connector of the instant disclosure.
Figure 2A:
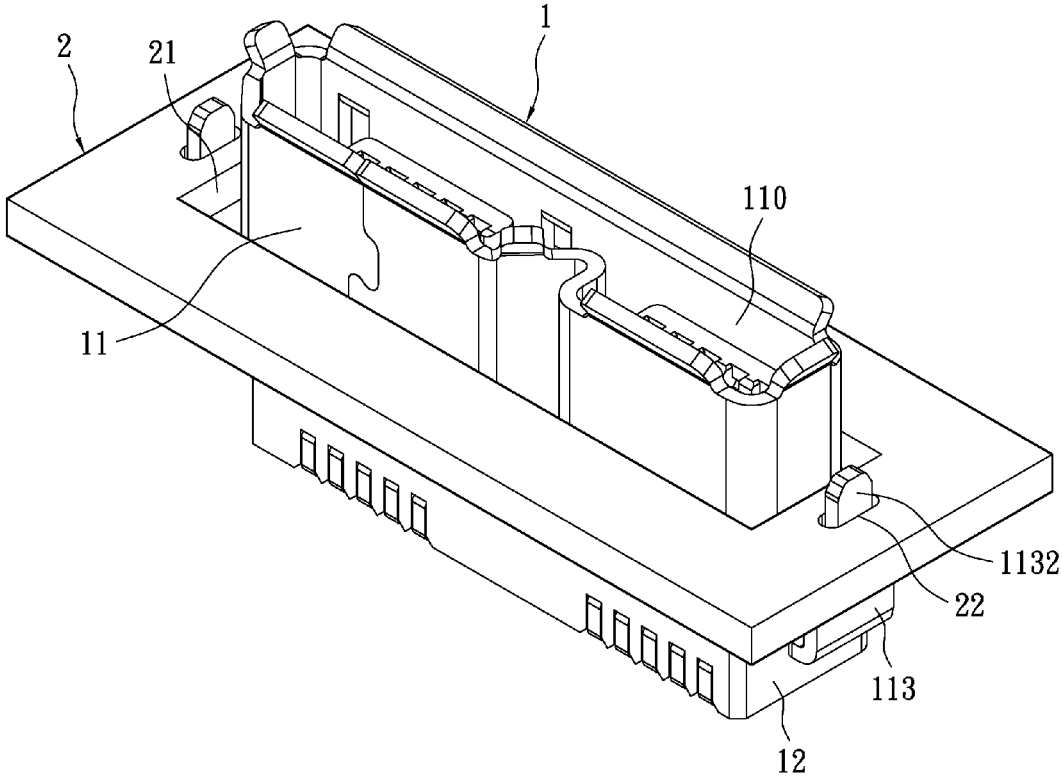
FIG. 2A shows another perspective view of the first embodiment of the vertical connector of the instant disclosure.

Please refer to FIGS. 1 and 2; the cross section of the conductive casing 11 is substantially a rectangular frame which has two opposite first side plates 11A and two opposite second side plates 11B. Each of the first side plates 11A has at least one retarding member formed bendingly by a pressing method. For example, a first retarding member 111 is bent from one of the first side plates 11A (as shown in FIG. 1) and a second retarding member 112 is bent from the other one of the first side plates 11A (as shown in FIG. 2). Please note that the position of the retarding member is leveled to that of the connecting segment 1313 to firmly support the vertical connector 1 on PCB 2. The number of the retarding member is not restricted thereby.

Moreover, the two second side plates 11B respectively have an assembling member 113 formed bendingly by the pressing method. The assembling member 113 is provided for improving the connection strength between the vertical connector 1 and PCB 2 so as to avoid the non-stability when the male connector inserts into the female slot. The assembling member 113, in structural detail, includes a supporting segment 1131 formed by bending the second side plate 11B and an insertion segment 1132 extending from the supporting segment 1131. Furthermore, the width of the insertion segment 1132 is smaller than that of the supporting segment 1131 so that there is a step structure formed between the supporting segment 1131 and the insertion segment 1132. The step structure is provided for improving the stability when the vertical connector 1 is assembled onto PCB 2.

Please refer to FIGS. 1, 1A, 2 and 2A; the vertical connector 1 is assembled onto PCB 2. In this exemplary embodiment, the connecting segment 1313 of each terminal 131 is a welding pin structure and the vertical connector 1 can be mounted on the PCB 2 by surface mounting method (SMT). In other words, the PCB 2 has conductive structures, such as conductive pads (not shown) corresponding to the welding pin structure so that the welding pin structure and the conductive structures can be weld to each other to fix the vertical connector 1 on the PCB 2.

Figure 4:
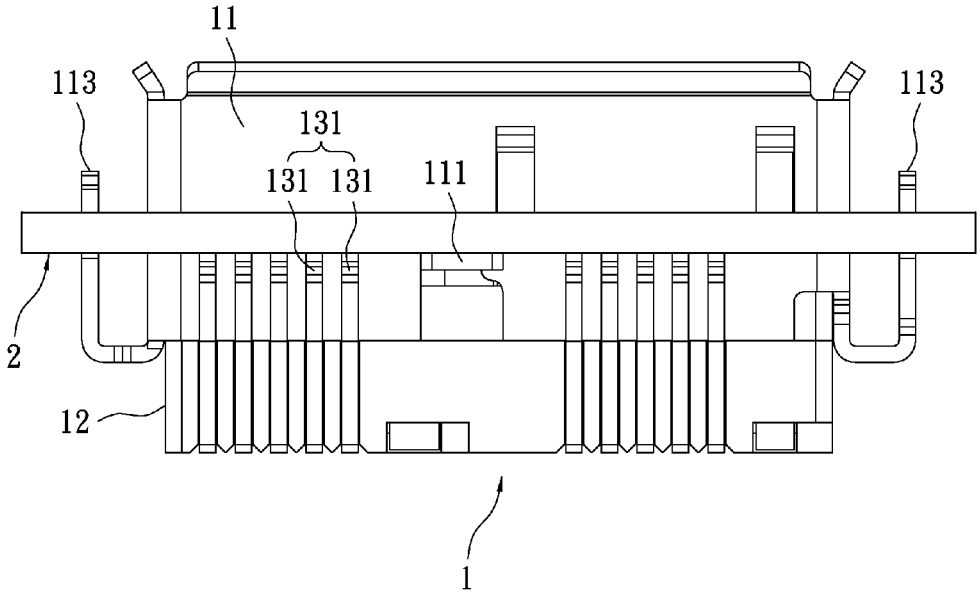
FIG. 4 shows a front view of the first embodiment of the vertical connector of the instant disclosure.
Figure 5:
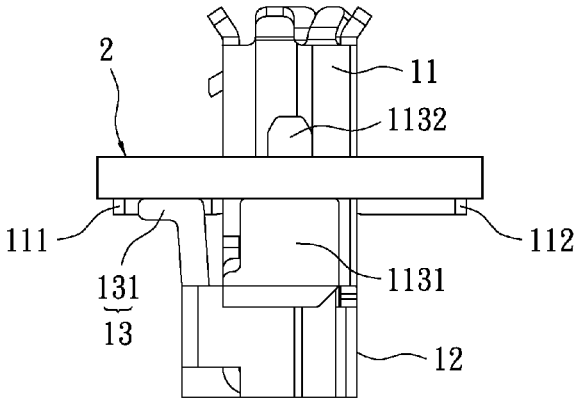
FIG. 5 shows a side view of the first embodiment of the vertical connector of the instant disclosure.

As shown, the PCB 2 has a fixing hole 21 corresponding to the vertical connector 1. A part of the conductive casing 11 of the vertical connector 1 penetrates through the fixing hole 21 until the connecting segment 1313 of each terminal 131 contacts the PCB 2 while assembling the vertical connector 1 to the PCB 2. Meanwhile, the retarding members (i.e., the first retarding member 111 and the second retarding member 112) contact the PCB 2, as shown in FIGS. 4 and 5, because the distance from the insertion opening 110 to the retarding members is substantially equal to the distance from the insertion opening 110 to the connecting segment 1313. Therefore, the retarding members may be provided for supporting the PCB 2 when the connecting segment 1313 of each terminal 131 is weld with the conductive structures of the PCB 2. As a result, the strength of the connecting vertical connector 1 and PCB 2 may be improved.

Further meanwhile, the insertion segment 1132 of the assembling member 113 inserts into the assembling hole 22 of PCB 2 when the connecting segment 1313 of each terminal 131 contacts the PCB 2. Thus, the relative position of the vertical connector 1 and PCB 2 is limited by inserting the insertion segment 1132 in the assembling hole 22. In other words, the vertical connector 1 cannot be moved relative to the PCB 2 even when external force is exerted on the vertical connector 1. On the other hand, the step structure formed between the supporting segment 1131 and the insertion segment 1132 is similarly provided for supporting the PCB 2 when the connecting segment 1313 of each terminal 131 is weld with the conductive structures of the PCB 2 so as to improve the structural strength between the vertical connector 1 and PCB 2.

Figure 6:
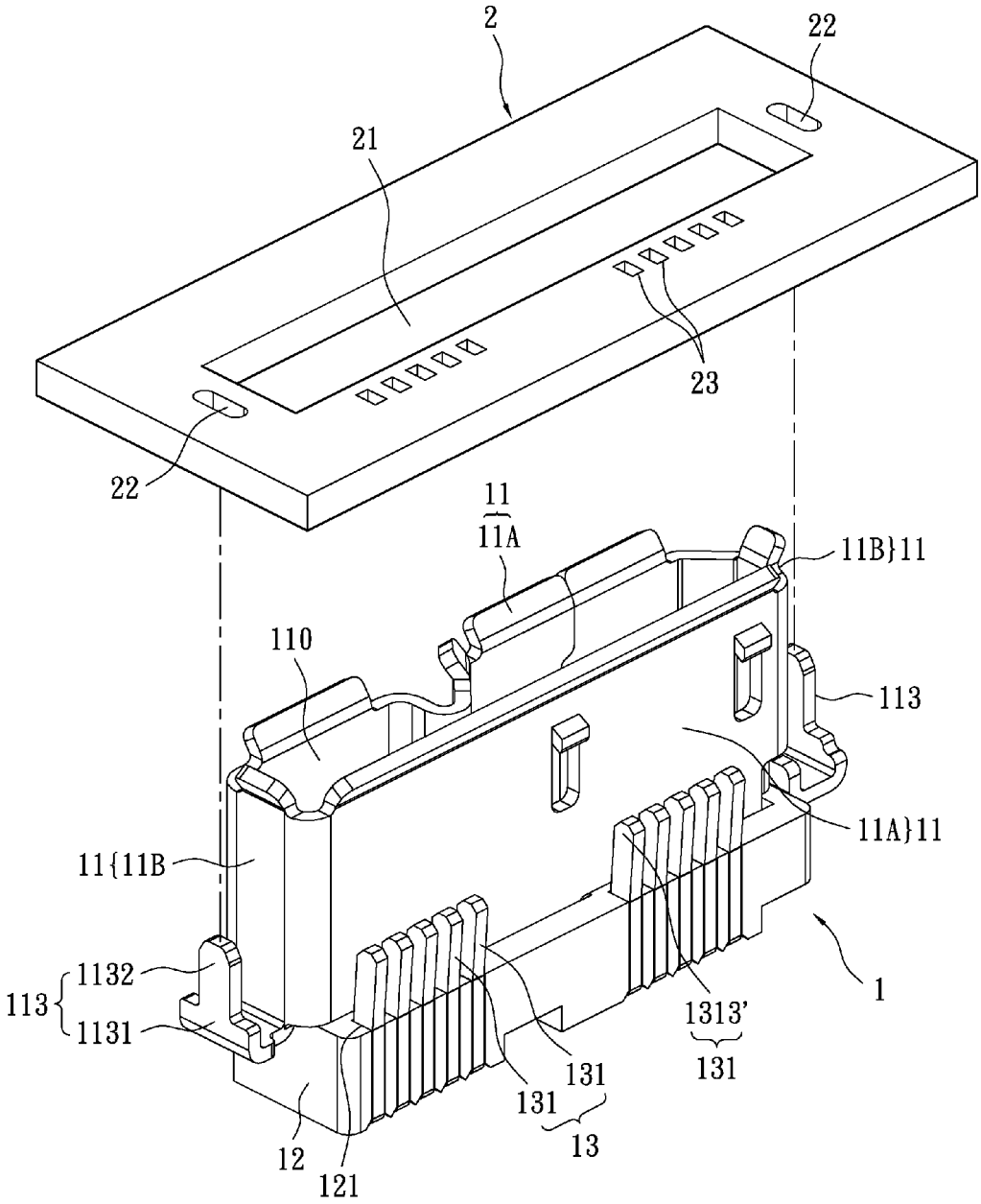
FIG. 6 shows an exploded view of the second embodiment of the vertical connector of the instant disclosure.
Figure 6A:
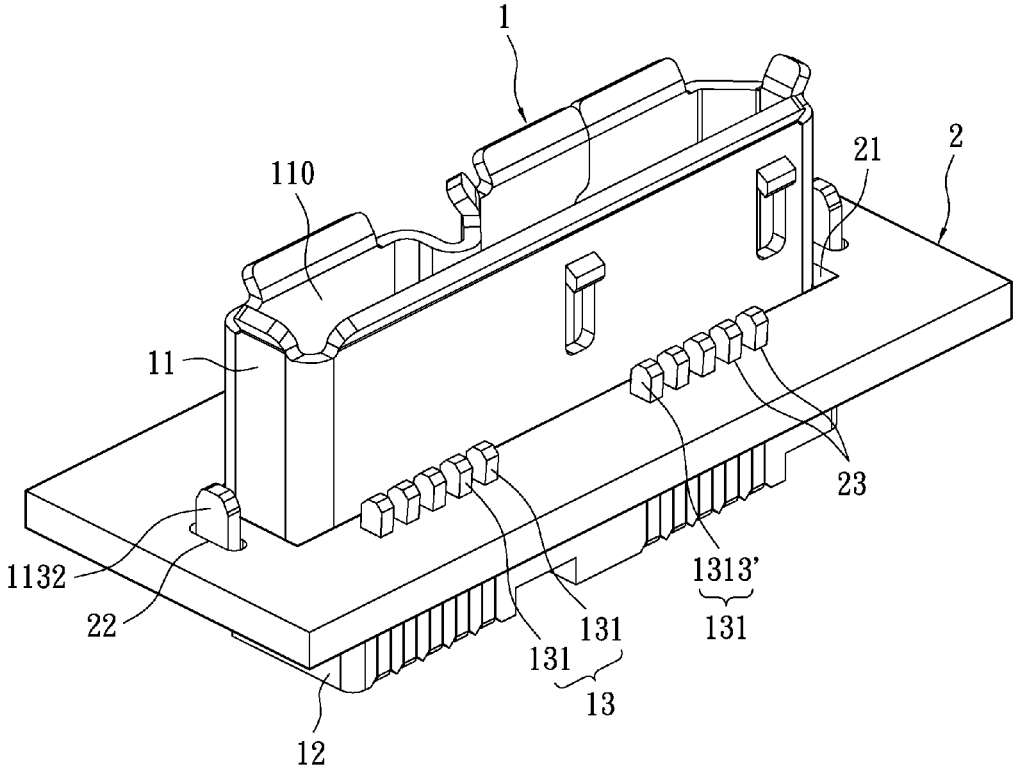
FIG. 6A shows a perspective view of the second embodiment of the vertical connector of the instant disclosure.

Please refer to FIGS. 6 and 6A; the vertical connector 1 of the second exemplary embodiment and PCB 2 are shown. In the exemplary embodiment, each terminal 131 is a terminal of DIP type; in other words, the connecting segment 1313' of each terminal 131 is an insertion pin structure. Correspondingly, the PCB 2 has insertion holes 23 for inserting the connecting segments 1313'. While assembling the vertical connector 1 to the PCB 2, a part of the conductive casing 11 of the vertical connector 1 penetrates through the fixing hole 21 until the connecting segment 1313' of each terminal 131 inserts into the corresponding insertion hole 23 of the PCB 2. Similarly with the first embodiment, when the connecting segment 1313' inserts into the corresponding insertion hole 23, the insertion segment 1132 of the assembling member 113 inserts into the assembling hole 22 of PCB 2 for limiting the movement of the vertical connector 1.

Accordingly, the terminal 131 elongates toward the insertion opening 110 so that the connecting segment 1313 (1313') closes to the insertion opening 110. As a result, the vertical connector 1 can penetrate through the PCB 2; in other words, two ends of the vertical connector 1 are respectively located at two opposite surfaces of the PCB 2. Thus, the protruding height of the vertical connector 1 can be reduced.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. A sinking-type vertical board-mount connector for vertically mounting through a hole in a printed circuit board (PCB), comprising:

an insulating body (12) having a plurality of spacedly arranged terminal grooves (121);

a conductive casing (11) assembled on the insulating body comprising a plurality of side plates (11A/B) defining an insertion opening (110), the conductive casing having at least one retarding member (111) and at least one assembling member (113) integrally bent and protrudingly extending from the side plates thereof, the retarding member (111) being configured to abut a first side of the PCB when the conductive casing is disposed through the hole thereof supporting the conductive casing (1) in an embedded configuration with the insertion opening (110) exposed on a second side of the PCB, and a terminal set (13) having a plurality of terminals (131) protrudingly disposed in the terminal grooves, wherein each of the terminals has a fixing segment (1311) assembled on a bottom surface of the insulating body, an extending segment (1312) bendingly extending from the fixing segment toward the insertion opening, and a connecting segment (1313) outwardly extending from the extending segment and arranged substantially horizontally leveled to the retarding member, configured to establish electrical contact with the first side of the PCB.

2. The connector as claimed in claim 1, wherein the connecting segment is a welding pin structure or an insertion pin structure.

3. The connector as claimed in claim 1, wherein the conductive casing is a metal casing having two opposite first side plates and two opposite second side plates.

4. The connector as claimed in claim 2, wherein the conductive casing is a metal casing having two opposite first side plates and two opposite second side plates.

5. The connector as claimed in claim 3, wherein the two opposite first side plates respectively have a retarding member, and the position of the connecting segment is corresponding to the retarding member.

6. The connector as claimed in claim 4, wherein the two opposite first side plates respectively have a retarding member, and the position of the connecting segment is corresponding to the retarding member.

7. The connector as claimed in claim 3, wherein the two second side plates respectively have an assembling member.

8. The connector as claimed in claim 4, wherein the two second side plates respectively have an assembling member.

9. The connector as claimed in claim 7, wherein the assembling member has a supporting segment formed by bending each of the second side plates and an insertion segment extending from the supporting segment.

10. The connector as claimed in claim 8, wherein the assembling member has a supporting segment formed by bending each of the second side plates and an insertion segment extending from the supporting segment.

11. The connector as claimed in claim 9, wherein a width of the insertion segment (1132) is smaller than a width of the supporting segment (1131), the supporting segment and the insertion segment cooperatively define a step structure.

12. The connector as claimed in claim 10, wherein a width of the insertion segment (1132) is smaller than a width of the supporting segment (1131), the supporting segment and the insertion segment cooperatively define a step structure.

13. A sinking-type vertical board-mount connector assembly, comprising:

a connector (1) including:

an insulating body (12) having a plurality of spacedly arranged terminal grooves (121), a conductive casing (11) assembled on the insulating body comprising a plurality of side plates (11A/B) defining an insertion opening (110), the conductive casing having at least one retarding member (111) and at least one assembling member (113) integrally bent and protrudingly extending from the side plates thereof, the retarding member (111) being configured to abut a first side of the PCB when the conductive casing is disposed through a through hole thereof, supporting the conductive casing (1) in an embedded configuration with the insertion opening (110) exposed on a second side of the PCB, and a terminal set (13) having a plurality of terminals (131) protrudingly disposed in the terminal grooves, wherein each of the terminals has a fixing segment (1311) assembled on a bottom surface of the insulating body, an extending segment (1312) bendingly extending from the fixing segment toward the insertion opening, and a connecting segment (1313) outwardly extending from the extending segment and arranged substantially horizontally leveled to the retarding member, configured to establish electrical contact with the first side of the PCB; and a printed circuit board (PCB) having the through hole through which the connector (1) is embeddedly assembled, wherein the connecting segment of each of the terminal electrically connects the first side of the PCB.

14. The assembly as claimed in claim 13, wherein the connecting segment is a welding pin structure and the PCB has a plurality of conductive structures corresponding to the welding pin structure, or the connecting segment is an insertion pin structure and the PCB has a plurality of insertion holes corresponding to the insertion pin structure.

15. The assembly as claimed in claim 13, wherein the conductive casing is a metal casing having two opposite first side plates and two opposite second side plates.

16. The assembly as claimed in claim 14, wherein the conductive casing is a metal casing having two opposite first side plates and two opposite second side plates.

17. The assembly as claimed in claim 15, wherein the two opposite first side plates respectively have a retarding member formed bendingly, and the position of the connecting segment is corresponding to the retarding member.

18. The assembly as claimed in claim 15, wherein the two second side plates respectively have an assembling member formed bendingly.

19. The assembly as claimed in claim 18, wherein the assembling member has a supporting segment formed by bending each of the second side plates and an insertion segment extending from the supporting segment, the PCB has a plurality of assembling holes corresponding to the insertion segment.

20. The assembly as claimed in claim 19, wherein a width of the insertion segment is smaller than a width of the supporting segment, and the supporting segment and the insertion segment has a step structure therebetween.

* * * * *